US005649426A

United States Patent [19]

Kalina et al.

[11] Patent Number: 5,649,426

[45] Date of Patent: Jul. 22, 1997

[54] METHOD AND APPARATUS FOR IMPLEMENTING A THERMODYNAMIC CYCLE

[75] Inventors: Alexander I. Kalina, Hillsborough; Richard I. Pelletier, San Leandro, both of Calif.

[73] Assignee: Exergy, Inc., Hayward, Calif.

[21] Appl. No.: 429,706

[22] Filed: Apr. 27, 1995

[51] Int. Cl.[6] ..... F01K 25/06

[52] U.S. Cl. ..... 60/649; 60/673

[58] Field of Search ..... 60/649, 673

[56] References Cited

U.S. PATENT DOCUMENTS

| | | | |
|---|---|---|---|
| 4,346,561 | 8/1982 | Kalina | 60/673 |
| 4,489,563 | 12/1984 | Kalina | 60/673 |
| 4,548,043 | 10/1985 | Kalina | 60/673 |
| 4,586,340 | 5/1986 | Kalina | 60/673 |
| 4,604,867 | 8/1986 | Kalina | 60/653 |
| 4,732,005 | 3/1988 | Kalina | 60/673 |
| 4,763,480 | 8/1988 | Kalina | 60/649 |
| 4,899,545 | 2/1990 | Kalina | 60/673 |
| 4,982,568 | 1/1991 | Kalina | 60/649 |
| 5,029,444 | 7/1991 | Kalina | 60/673 |
| 5,095,708 | 3/1992 | Kalina | 60/673 |
| 5,440,882 | 8/1995 | Kalina | 60/641.2 |
| 5,450,821 | 9/1995 | Kalina | 122/1 R |
| 5,572,871 | 11/1996 | Kalina | 60/649 |

*Primary Examiner*—Stephen F. Husar
*Assistant Examiner*—Alfred Basichas
*Attorney, Agent, or Firm*—Fish & Richardson P.C.

[57] ABSTRACT

A method and apparatus for implementing a thermodynamic cycle. A heated gaseous working stream including a low boiling point component and a higher boiling point component is expanded to transform the energy of the stream into useable form and to provide an expanded working stream. The expanded working stream is then split into two streams, one of which is expanded further to obtain further energy, resulting in a spent stream, the other of which is extracted. The spent stream is fed into a distillation/condensation subsystem, which converts the spent stream into a lean stream that is lean with respect to the low boiling point component and a rich stream that is enriched with respect to the low boiling point component. The lean stream and the rich stream are then combined in a regenerating subsystem with the portion of the expanded stream that was extracted to provide the working stream, which is then efficiently heated in a heater to provide the heated gaseous working stream that is expanded.

38 Claims, 1 Drawing Sheet

METHOD AND APPARATUS FOR IMPLEMENTING A THERMODYNAMIC CYCLE

BACKGROUND OF THE INVENTION

The invention relates to implementing a thermodynamic cycle.

Thermal energy from a heat source can be transformed into mechanical and then electrical form using a working fluid that is expanded and regenerated in a closed system operating on a thermodynamic cycle. The working fluid can include components of different boiling temperatures, and the composition of the working fluid can be modified at different places within the system to improve the efficiency of operation. Systems with multicomponent working fluids are described in Alexander I. Kalina's U.S. Pat. Nos. 4,346,561; 4,489,563; 4,548,043; 4,586,340; 4,604,867; 4,732,005; 4,763,480; 4,899,545; 4,982,568; 5,029,444; 5,095,708; 5,440,882; 5,450,821; and 5,572,871, which are hereby incorporated by reference. U.S. Pat. No. 4,899,545 describes a system in which the expansion of the working fluid is conducted in multiple stages, and a portion of the stream between expansion stages is intermixed with a stream that is lean with respect to a lower boiling temperature component and thereafter is introduced into a distillation column that receives a spent, fully expanded stream and is combined with other streams.

SUMMARY OF THE INVENTION

The invention features, in general, a method and apparatus for implementing a thermodynamic cycle. A heated gaseous working stream including a low boiling point component and a higher boiling point component is expanded to transform the energy of the stream into useable form and to provide an expanded working stream. The expanded working stream is then split into two streams, one of which is expanded further to obtain further energy, resulting in a spent stream, the other of which is extracted. The spent stream is fed into a distillation/condensation subsystem, which converts the spent stream into a lean stream that is lean with respect to the low boiling point component and a rich stream that is enriched with respect to the low boiling point component. The lean stream and the rich stream are then combined in a regenerating subsystem with the portion of the expanded stream that was extracted to provide the working stream, which is then efficiently heated in a heater to provide the heated gaseous working stream that is expanded.

In preferred embodiments the lean stream and the rich stream that are outputted by the distillation/condensation subsystem are fully condensed streams. The lean stream is combined with the expanded stream to provide an intermediate stream, which is cooled to provide heat to preheat the rich stream, and thereafter the intermediate stream is combined with the preheated rich stream. The intermediate stream is condensed during the cooling, is thereafter pumped to increase its pressure, and is preheated prior to combining with the preheated rich stream using heat from the cooling of the intermediate stream. The lean stream is also preheated using heat from the cooling of the intermediate stream prior to mixing with the expanded stream. The working stream that is regenerated from the lean and rich streams is thus preheated by the heat of the expanded stream mixed with them to provide for efficient heat transfer when the regenerated working stream is then heated.

Preferably the distillation/condensation subsystem produces a second lean stream and combines it with the spent stream to provide a combined stream that has a lower concentration of low boiling point component than the spent stream and can be condensed at a low pressure, providing improved efficiency of operation of the system by expanding to the low pressure. The distillation/condensation subsystem includes a separator that receives at least part of the combined stream, after it has been condensed and recuperatively heated, and separates it into an original enriched stream in the form of a vapor and the original lean stream in the form of a liquid. Part of the condensed combined stream is mixed with the original enriched stream to provide the rich stream. The distillation/condensation subsystem includes heat exchangers to recuperatively heat the combined condensed stream prior to separation in the separator, to preheat the rich stream after it has been condensed and pumped to high pressure, to cool the spent stream and lean stream prior to condensing, and to cool the enriched stream prior to mixing with the condensed combined stream.

Other advantages and features of the invention will be apparent from the following description of the preferred embodiment thereof and from the claims.

DESCRIPTION OF THE PREFERRED EMBODIMENT

Figure 1:
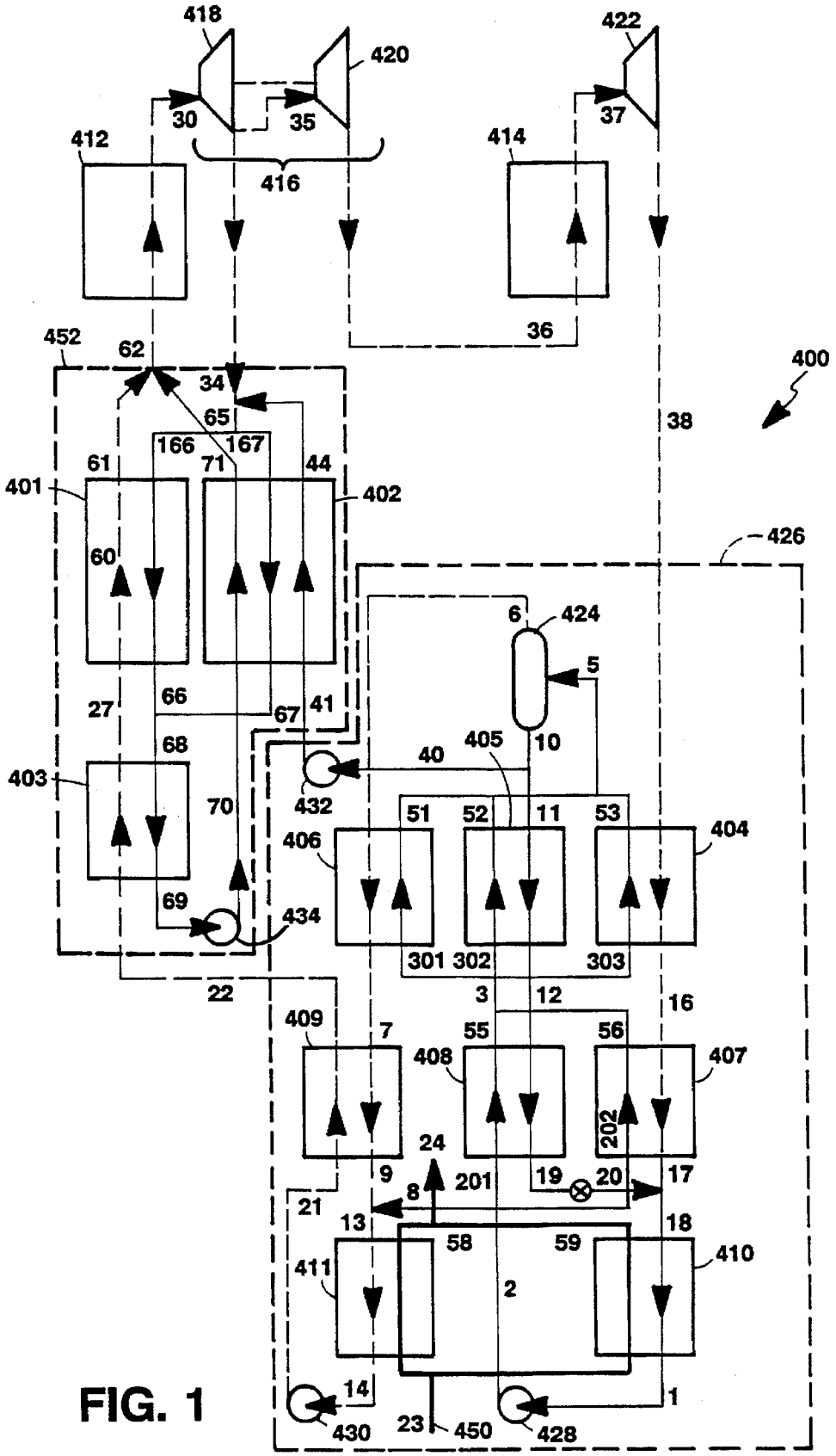
FIG. 1 is a schematic representation of a system for implementing a thermodynamic cycle according to the invention.

Referring to FIG. 1, there is shown apparatus 400 for implementing a thermodynamic cycle, using heat obtained from combusting fuel, e.g. refuse, in heater 412 and reheater 414, and using water 450 at a temperature of 57° F. as a low temperature source. Apparatus 400 includes, in addition to heater 412 and reheater 414, heat exchangers 401–411, high pressure turbine 416, low pressure turbine 422, gravity separator 424, and pumps 428, 430, 432, 434. A two-component working fluid including water and ammonia (which has a lower boiling point than water) is employed in apparatus 400. Other multicomponent fluids can be used, as described in the above-referenced patents.

High pressure turbine 416 includes two stages 418, 420, each of which acts as a gas expander and includes mechanical components that transform the energy of the heated gas being expanded therein into useable form as it is being expanded.

Heat exchangers 405–411, separator 424, and pumps 428–432 make up distillation/condensation subsystem 426, which receives a spent stream from low pressure turbine 422 and converts it to a first lean stream (at point 41 on FIG. 1) that is lean with respect to the low boiling point component and a rich stream (at point 22) that is enriched with respect to the low boiling point component.

Heat exchangers 401, 402 and 403 and pump 434 make up regenerating subsystem 452, which regenerates the working stream (point 62) from an expanded working stream (point 34) from turbine stage 418, and the lean stream (point 41) and the rich stream (22) from distillation/condensation subsystem 426.

Apparatus 400 works as is discussed below. The parameters of key points of the system are presented in Table 1.

The entering working fluid, called a "spent stream," is saturated vapor exiting low pressure turbine 422. The spent stream has parameters as at point 38, and passes through heat exchanger 404, where it is partially condensed and cooled, obtaining parameters as at point 16. The spent stream with parameters as at point 16 then passes through heat exchanger 407, where it is further partially condensed and cooled, obtaining parameters as at point 17. Thereafter, the spent stream is mixed with a stream of liquid having parameters as at point 20; this stream is called a "lean stream" because it contains significantly less low boiling component (ammonia) than the spent stream. The "combined stream" that results from this mixing (point 18) has low concentration of low boiling component and can therefore be fully condensed at a low pressure and available temperature of cooling water. This permits a low pressure in the spent stream (point 38), improving the efficiency of the system.

The combined stream with parameters as at point 18 passes through heat exchanger 410, where it is fully condensed by a stream of cooling water (points 23–59), and obtains parameters as at point 1. Thereafter, the condensed combined stream with parameters as at point 1 is pumped by pump, 428 to a higher pressure. As a result, after pump 428, the combined stream obtains parameters as at point 2. A portion of the combined stream with parameters as at point 2 is separated from the stream. This portion has parameters as at point 8. The rest of the combined stream is divided into two substreams, having parameters as at points 201 and 202 respectively. The portion of the combined stream having parameters as at point 202 enters heat exchanger 407, where it is heated in counterflow by spent stream 16-17 (see above), and obtains parameters as at point 56. The portion of the combined stream having parameters as at point 201 enters heat exchanger 408, where it is heated in counterflow by lean stream 12-19 (see below), and obtains parameters as at point 55. In the preferred embodiment of this design, the temperatures at points 55 and 56 would be close to each other or equal.

Thereafter, those two streams are combined into one stream having parameters as at point 3. The stream with parameters as at point 3 is then divided into three substreams having parameters as at points 301, 302, and 303, respectively. The stream having parameters as at point 303 is sent into heat exchanger 404, where it is further heated and partially vaporized by spent stream 38-16 (see above) and obtains parameters as at point 53. The stream having parameters as at point 302 is sent into heat exchanger 405, where it is further heated and partially vaporized by lean stream 11-12 (see below) and obtains parameters as at point 52. The stream having parameters as at point 301 is sent into heat exchanger 406, where it is further heated and partially vaporized by "original enriched stream" 6-7 (see below) and obtains parameters as at point 51. The three streams with parameters as at points 51, 52, and 53 are then combined into a single combined stream having parameters as at point 5.

The combined stream with parameters as at point 5 is sent into the gravity separator 424. In the gravity separator 424, the stream with parameters as at point 5 is separated into an "original enriched stream" of saturated vapor having parameters as at point 6 and an "original lean stream" of saturated liquid having parameters as at point 10. The saturated vapor with parameters as at point 6, the original enriched stream, is sent into heat exchanger 406, where it is cooled and partially condensed by stream 301-51 (see above), obtaining parameters as at point 7. Then the original enriched stream with parameters as at point 7 enters heat exchanger 409, where it is further cooled and partially condensed by "rich stream" 21-22 (see below), obtaining parameters as at point 9.

The original enriched stream with parameters as at point 9 is then mixed with the combined condensed stream of liquid having parameters as at point 8 (see above), creating a so-called "rich stream" having parameters as at point 13. The composition and pressure at point 13 are such that this rich stream can be fully condensed by cooling water of available temperature. The rich stream with parameters as at point 13 passes through heat exchanger 411, where it is cooled by water (stream 23-58), and fully condensed, obtaining parameters as at point 14. Thereafter, the fully condensed rich stream with parameters as at point 14 is pumped to a high pressure by a feed pump 430 and obtains parameters as at point 21. The rich stream with parameters as at point 21 is now in a state of subcooled liquid. The rich stream with parameters as at point 21 then enters heat exchanger 409, where it is heated by the partially condensed original enriched stream 7-9 (see above), to obtain parameters as at point 22. The rich stream with parameters as at point 22 is one of the two fully condensed streams outputted by distillation/condensation subsystem 426.

Returning now to gravity separator 424, the stream of saturated liquid produced there (see above), called the original lean stream and having parameters as at point 10, is divided into two lean streams, having parameters as at points 11 and 40. The first lean stream has parameters as at point 40, is pumped to a high pressure by pump 432, and obtains parameters as at point 41. This first lean stream with parameters at point 41 is the second of the two fully condensed streams outputted by distillation/condensation subsystem 426. The second lean stream having parameters as at point 11 enters heat exchanger 405, where it is cooled, providing heat to stream 302-52 (see above), obtaining parameters as at point 12. Then the second lean stream having parameters as at point 12 enters heat exchanger 408, where it is further cooled, providing heat to stream 201-55 (see above), obtaining parameters as at point 19. The second lean stream having parameters as at point 19 is throttled to a lower pressure, namely the pressure as at point 17, thereby obtaining parameters as at point 20. The second lean stream having parameters as at point 20 is then mixed with the spent stream having parameters as at point 17 to produce the combined stream having parameters as at point 18, as described above.

As a result of the process described above, the spent stream from low pressure turbine 422 with parameters as at point 38 has been fully condensed, and divided into two liquid streams, the rich stream and the lean stream, having parameters as at point 22 and at point 41, respectively, within distillation/condensation subsystem 426. The sum total of the flow rates of these two streams is equal to the weight flow rate entering the subsystem 426 with parameters as at point 38. The compositions of streams having parameters as at point 41 and as at point 22 are different. The flow rates and compositions of the streams having parameters as at point 22 and at 41, respectively, are such that would those two streams be mixed, the resulting stream would have the flow rate and compositions of a stream with parameters as at point 38. But the temperature of the rich stream having parameters as at point 22 is lower than temperature of the lean stream having parameters as at point 41. As is described below, these two streams are combined with an expanded stream having parameters as at point 34 within regenerating subsystem 452 to make up the working fluid that is heated and expanded in high pressure turbine 416.

The subcooled liquid rich stream having parameters as at point 22 enters heat exchanger 403 where it is preheated in counterflow to stream 68-69 (see below), obtaining parameters as at point 27. As a result, the temperature at point 27 is close to or equal to the temperature at point 41.

The rich stream having parameters as at point 27 enters heat exchanger 401, where it is further heated in counterflow by "intermediate stream" 166-66 (see below) and partially or completely vaporized, obtaining parameters as at point 61. The liquid lean stream having parameters as at point 41 enters heat exchanger 402, where it is heated by stream 167-67 and obtains parameters as at point 44. The lean stream with parameters as at point 44 is then combined with an expanded stream having parameters as at point 34 from turbine stage 418 (see below) to provide the "intermediate stream" having parameters as at point 65. This intermediate stream is then split into two intermediate streams having parameters as at points 166 and 167, which are cooled in travel through respective heat exchangers 401 and 402, resulting in streams having parameters as at points 66 and 67. These two intermediate streams are then combined to create an intermediate stream having parameters as at point 68. Thereafter the intermediate stream with parameters as at point 68 enters heat exchanger 403, where it is cooled providing heat for preheating rich stream 22-27 (see above) in obtaining parameters as at point 69. Thereafter, the intermediate stream having parameters as at point 69 is pumped to a high pressure by pump 434 and obtains parameters as at point 70. Then the intermediate stream having parameters as at point 70 enters heat exchanger 402 in parallel with the lean stream having parameters as at point 41. The intermediate stream having parameters as at point 70 is heated in heat exchanger 402 in counterflow to stream 167-67 (see above) and obtains parameters as at point 71.

The rich stream having parameters as at point 61 and the intermediate stream having parameters as at point 71 are mixed together, obtaining the working fluid with parameters as at point 62. The working stream having parameters as at point 62 then enters heater 412, where it is heated by the external heat source, and obtains parameters as at point 30, which in most cases corresponds to a state of superheated vapor.

The working stream having parameters as at point 30 entering high pressure turbine 418 is expanded and produces mechanical power, which can then be converted to electrical power. In the mid-section of high pressure turbine 416, part of the initially expanded stream is extracted and creates an expanded stream with parameters as at point 34. The expanded stream having parameters as at point 34 is then mixed with the lean stream having parameters as at point 44 (see above). As a result of this mixing, the "intermediate stream" with parameters as at point 65 is created. The remaining portion of the expanded stream passes through the second stage 420 of high pressure turbine 416 with parameters as at point 35, continuing its expansion, and leaves high pressure turbine 416 with parameters as at point 36.

It is clear from the presented description that the composition of the intermediate stream having parameters as at point 71 is equal to the composition of the intermediate stream having parameters as at point 65. It is also clear that the composition of the working stream having parameters as at point 62, which is a result of a mixing of the streams with parameters as at points 71 and 61, respectively, (see above) is equal to the composition of the expanded stream having parameters as at point 34.

The sequence of mixing described above is as follows: First the lean stream with parameters as at point 44 is added to the expanded stream of working composition with parameters as at point 34. Thereafter this mixture is combined with the rich stream having parameters as at point 61 (see above). Because the combination of the lean stream (point 44) and the rich stream (point 61), would be exactly the working composition (i.e., the composition of the spent stream at point 38), it is clear that the composition of the working stream having parameters as at point 62 (resulting from mixing of streams having composition as at points 34, 44 and 61) is equal to the composition of the spent stream at point 38. This working stream (point 62) that is regenerated from the lean and rich streams is thus preheated by the heat of the expanded stream mixed with them to provide for efficient heat transfer when the regenerated working stream is then heated in heater 412.

The expanded stream leaving the high pressure turbine 416 and having parameters as at point 36 (see above) is passed through reheater 414, where it is heated by the external source of heat and obtains parameters as at point 37. Thereafter, the expanded stream with parameters as at point 37 passes through low pressure turbine 422, where it is expanded, producing mechanical power, and obtains as a result parameters as at point 38 (see above).

The cycle is closed.

Parameters of operation of the proposed system presented in Table 1 correspond to a condition of composition of a low grade fuel such as municipal waste, biomass, etc. A summary of the performance of the system is presented in Table 2. Output of the proposed system for a given heat source is equal to 12.79 Mw. By way of comparison, Rankine Cycle technology, which is presently being used, at the same conditions would produce an output of 9.2 Mw. As a result, the proposed system has an efficiency 1.39 times higher than that of Rankine Cycle technology.

Other embodiments of the invention are within the scope of the claims. E.g., in the described embodiment, the vapor is extracted from the mid-point of the high pressure turbine 416. It is obvious that it is possible to extract vapor for regenerating subsystem 452 from the exit of high pressure turbine 416 and to then send the remaining portion of the stream through the reheater 414 into the low pressure turbine 422. It is, as well, possible to reheat the stream sent to low pressure turbine 422 to a temperature which is different from the temperature of the stream entering the high pressure turbine 416. It is, as well, possible to send the stream into low pressure turbine with no reheating at all. One experienced in the art can find optimal parameters for the best performance of the described system.

TABLE 1

| # | P psiA | X | T °F. | H BTU/lb | G/G30 | Flow lb/hr | Phase |
|---|---|---|---|---|---|---|---|
| 1 | 33.52 | .4881 | 64.00 | −71.91 | 2.0967 | 240,246 | Sat Liquid |
| 2 | 114.87 | .4881 | 64.17 | −71.56 | 2.0967 | 240,246 | Liq 69° |
| 201 | 114.87 | .4881 | 64.17 | −71.56 | 2.0967 | 64,303 | Liq 69° |
| 202 | 114.87 | .4881 | 64.17 | −71.56 | 2.0967 | 165.066 | Liq 69° |
| 3 | 109.87 | .4881 | 130.65 | −0.28 | 2.0018 | 229,369 | Sat Liquid |
| 301 | 109.87 | .4881 | 130.65 | −0.28 | 2.0018 | 36.352 | Sat Liquid |

TABLE 1-continued

| # | P psiA | X | T °F. | H BTU/lb | G/G30 | Flow lb/hr | Phase |
|---|---|---|---|---|---|---|---|
| 302 | 109.87 | .4881 | 130.65 | −0.28 | 2.0018 | 31,299 | Sat Liquid |
| 303 | 109.87 | .4881 | 130.65 | −0.28 | 2.0018 | 161,717 | Sat Liquid |
| 5 | 104.87 | .4881 | 192.68 | 259.48 | 2.0018 | 229.369 | Wet .6955 |
| 6 | 104.87 | .9295 | 192.68 | 665.53 | .6094 | 69,832 | Sat Vapor |
| 7 | 103.87 | .9295 | 135.65 | 539.57 | .6094 | 69,832 | Wet .108 |
| 8 | 114.87 | .4881 | 64.17 | −71.56 | .0949 | 10,877 | Liq 69° |
| 9 | 102.87 | .9295 | 96.82 | 465.32 | .6094 | 69,832 | Wet .1827 |
| 10 | 104.87 | .2950 | 192.68 | 81.75 | 1.3923 | 159,537 | Sat Liquid |
| 11 | 104.87 | .2950 | 192.68 | 81.75 | 1.0967 | 125,663 | Sat Liquid |
| 12 | 104.87 | .2950 | 135.65 | 21.48 | 1.0967 | 125,663 | Liq 57° |
| 13 | 102.87 | .8700 | 103.53 | 392.97 | .7044 | 80.709 | Wet .31 |
| 14 | 102.57 | .8700 | 64.00 | −5.01 | .7044 | 80.709 | Sat Liquid |
| 16 | 34.82 | .7000 | 135.65 | 414.29 | 1.0000 | 114,583 | Wet .3627 |
| 17 | 33.82 | .7000 | 100.57 | 311.60 | 1.0000 | 114,583 | Wet .4573 |
| 18 | 33.82 | .4881 | 111.66 | 140.77 | 2.0967 | 240,246 | Wet .7554 |
| 19 | 99.87 | .2950 | 100.57 | −15.00 | 1.0967 | 125,663 | Liq 89° |
| 20 | 33.82 | .2950 | 100.72 | −15.00 | 1.0967 | 125,663 | Liq 24° |
| 21 | 2450.00 | .8700 | 71.84 | 7.24 | .7044 | 80,709 | Liq 278° |
| 22 | 2445.00 | .8700 | 130.65 | 71.49 | .7044 | 80,709 | Liq 219° |
| 23 | | Water | 57.00 | 25.00 | 29.1955 | 3,345,311 | |
| 24 | | Water | 81.88 | 49.88 | 29.1955 | 3,345,311 | |
| 25 | | Air | 1742.00 | 0.00 | .0000 | 0 | |
| 26 | | Air | 428.00 | 0.00 | .0000 | 0 | |
| 27 | 2443.00 | .8700 | 153.57 | 97.05 | .7044 | 80,709 | Liq 196° |
| 30 | 2415.00 | .7000 | 600.00 | 909.64 | 1.9093 | 218,777 | Vap 131° |
| 31 | 828.04 | .7000 | 397.35 | 817.55 | 1.9093 | 218,777 | Wet .0289 |
| 33 | 828.04 | .7000 | 397.35 | 817.55 | 1.0000 | 114,583 | Wet .0289 |
| 34 | 828.04 | .7000 | 397.35 | 817.55 | .9093 | 104,194 | Wet .0289 |
| 35 | 828.04 | .7000 | 397.35 | 817.55 | 1.0000 | 114,583 | Wet .0289 |
| 36 | 476.22 | .7000 | 349.17 | 776.09 | 1.0000 | 114,583 | Wet .0746 |
| 37 | 466.22 | .7000 | 600.00 | 996.69 | 1.0000 | 114,583 | Vap 242° |
| 38 | 35.82 | .7000 | 199.68 | 791.41 | 1.0000 | 114,583 | Sat Vapor |
| 40 | 104.87 | .2950 | 192.68 | 81.75 | .2956 | 33,874 | Sat Liquid |
| 41 | 838.04 | .2950 | 194.17 | 84.79 | .2956 | 33,874 | Liq 187° |
| 44 | 828.04 | .2950 | 380.00 | 298.67 | .2956 | 33,874 | Sat Liquid |
| 45 | 818.04 | .6006 | 267.07 | 170.05 | 1,2050 | 138,069 | Sat Liquid |
| 51 | 104.87 | .4881 | 187.68 | 241.69 | .3173 | 36,352 | Wet .7134 |
| 52 | 104.87 | .4881 | 187.68 | 241.69 | .2732 | 31,299 | Wet .7134 |
| 53 | 104.87 | .4881 | 194.77 | 266.93 | 1.4114 | 161,717 | Wet .6822 |
| 55 | 109.87 | .4881 | 130.65 | −0.28 | .5612 | 64.303 | Sat Liquid |
| 56 | 109.87 | .4881 | 130.65 | −0.28 | 1.4406 | 165,066 | Sat Liquid |
| 58 | | Water | 72.01 | 40.01 | 18.6721 | 2,139,505 | |
| 59 | | Water | 99.37 | 67.37 | 10.5234 | 1,205,805 | |
| 60 | 2435.00 | .8700 | 350.06 | 447.47 | .7044 | 80,709 | Vap 0° |
| 61 | 2425.00 | .8700 | 380.00 | 576.27 | .7044 | 80,709 | Vap 30° |
| 62 | 2425.00 | .7000 | 390.03 | 433.90 | 1.9093 | 218,777 | Wet .9368 |
| 65 | 828.04 | .6006 | 394.11 | 690.25 | 1.2050 | 138.069 | Wet .2666 |
| 66 | 828.04 | .6006 | 394.11 | 690.25 | 1.2050 | 64,317 | Wet .2666 |
| 67 | 828.04 | .6006 | 394.11 | 690.25 | 1.2050 | 73,752 | Wet .2666 |
| 66 | 818.04 | .6006 | 200.68 | 88.90 | .5613 | 64,317 | Liq 66° |
| 67 | 818.04 | .6006 | 200.68 | 88.90 | .6437 | 73,752 | Liq 66° |
| 68 | 818.04 | .6006 | 200.68 | 88.90 | 1.2050 | 138,069 | Liq 66° |
| 69 | 816.04 | .6006 | 187.68 | 73.96 | 1.2050 | 138,069 | Liq 79° |
| 70 | 2443.00 | .6006 | 193.38 | 81.94 | 1.2050 | 138,069 | Liq 219° |
| 71 | 2425.00 | .6006 | 380.00 | 350.68 | 1.2050 | 138,069 | Liq 31° |

TABLE 2

Note: "BTU/lb" is per pound of working fluid AT POINT 38

| Heat Acquisition | BTU/lb | M BTU/hr | MW therm |
|---|---|---|---|
| Htr 1 pts 62–30 | 908.34 | 104.08 | 30.50 |
| Htr 2 pts 36–37 | 220.60 | 25.28 | 7.41 |
| Total Fuel Heat | | 129.36 | 37.91 |
| Total Heat Input | 1128.94 | 129.36 | 37.91 |
| Heat Rejection | 726.25 | 83.22 | 24.39 |

| Pump Work | VΔP Work | Heat Input Equivalent | Power BTU/lb | Power MW e |
|---|---|---|---|---|
| Pump 69–70 | 6.78 | 9.61 | 10.21 | 0.34 |
| Pump 14–21 | 10.42 | 8.63 | 9.17 | 0.31 |

TABLE 2-continued

Note: "BTU/lb" is per pound of working fluid AT POINT 38

| | | | | |
|---|---|---|---|---|
| Pump 1–2 | 0.29 | 0.72 | 0.76 | 0.03 |
| Pump 40–41 | 2.58 | 0.90 | 0.95 | 0.03 |
| Total pumps | | 19.86 | 21.11 | 0.71 |

| Turbines | MWe | GΔH | ΔH | ΔH isen | ATE |
|---|---|---|---|---|---|
| HPT (30–31) | 5.90 | 175.82 | 92.09 | 107.08 | .86 |
| IPT (35–36) | 1.39 | 41.46 | 41.46 | 48.21 | .86 |
| LPT (37–38) | 6.89 | 205.28 | 205.28 | 238.70 | .86 |
| Total: | 14.19 | 422.56 | | | |

TABLE 2-continued

Note: "BTU/lb" is per pound of working fluid AT POINT 38

| Performance Summary S9 | | |
|---|---|---|
| Total Heat to Plant | 37.91 MW | |
| Heat to Working Fluid | 37.91 MW | 1128.94 BTU/lb |
| Σ Turbine Expansion Work | 14.19 MW | 422.56 BTU/lb |
| Gross Electrical Output | 13.84 MW | 411.99 BTU/lb |
| Cycle Pump Power | 0.71 MW | 21.11 BTU/lb |
| Water Pump & Fan | 0.34 MW | 9.98 BTU/lb |
| Other Auxiliaries | 0.00 MW | |
| Plant Net Output | 12.79 MW | 380.90 BTU/lb |
| Gross Cycle Efficiency | 34.62% | |
| Net Thermal Efficiency | 33.74% | |
| Net Plant Efficiency | 33.74% | |
| First Law Efficiency | 37.43% | |
| Second Law Efficiency | 58.99% | |
| Second Law Maximum | 63.45% | |
| Turbine Heat Rate | 10113.07 BTU/kWh | |
| Flow Rate at Point 100 | 114583 lb/hr | |

What is claimed is:

1. A method of implementing a thermodynamic cycle comprising expanding a heated gaseous working stream including a low boiling point component and a higher boiling point component to transform the energy of said stream into useable form and provide an expanded working stream, splitting said expanded working stream into a first expanded stream and a second expanded stream, expanding said first expanded stream to transform its energy into useable form and provide a spent stream, feeding said spent stream into a distillation/condensation subsystem and outputting therefrom a first lean stream that is lean with respect to said low boiling point component and a rich stream that is enriched with respect to said low boiling point component, combining said second expanded stream with said lean stream and said rich stream to provide said working stream, and adding heat to said working stream to provide said heated gaseous working stream.

2. The method of claim 1 further comprising heating said first working stream prior to said expanding said first working stream.

3. The method of claim 1 wherein said lean stream and said rich stream that are outputted by said distillation/condensation subsystem are fully condensed streams.

4. The method of claim 3 wherein said combining includes first combining said first lean stream with said second expanded stream to provide an intermediate stream, and thereafter cooling said intermediate stream to provide heat to preheat said rich stream, and thereafter combining said intermediate stream with said preheated rich stream.

5. The method of claim 4 wherein said intermediate stream is condensed during said cooling and is thereafter pumped to increase its pressure and is preheated prior to said combining with said preheated rich stream using heat from said cooling of said intermediate stream.

6. The method of claim 5 wherein said first lean stream is preheated using heat from said cooling of said intermediate stream prior to mixing with said second stream.

7. The method of claim 5 further comprising generating a second lean stream in said distillation/condensation subsystem, combining said second lean stream with said spent stream in said distillation/condensation subsystem to provide a combined stream, and condensing said combined stream by transferring heat to a low temperature fluid source.

8. The method of claim 7 further comprising separating at least part of said combined stream in said distillation/condensation subsystem into an original lean stream used to provide said first and second lean streams and an original enriched stream used to provide said rich stream, wherein said original enriched stream is in the form of a vapor, said original lean stream is in the form of a liquid, and said separating is carried out in a separator in said distillation/condensation subsystem.

9. The method of claim 8 further comprising splitting said combined stream in said distillation/condensation subsystem into a first combined stream portion that is separated into said original lean stream and said original enriched stream and a second combined stream portion, and mixing said second combined stream portion with said original enriched stream to provide said rich stream.

10. The method of claim 9 wherein said rich stream is condensed in said distillation/condensation subsystem by transferring heat to said low temperature fluid source and is pumped to increase its pressure.

11. The method of claim 10 wherein said original enriched stream is cooled by transferring heat to preheat and partially vaporize said at least part of said combined stream prior to separating in said separator.

12. The method of claim 11 wherein said original enriched stream is cooled by transferring heat to preheat said rich stream.

13. The method of claim 1 further comprising generating a second lean stream in said distillation/condensation subsystem, combining said second lean stream with said spent stream in said distillation/condensation subsystem to provide a combined stream, and condensing said combined stream by transferring heat to a low temperature fluid source.

14. The method of claim 13 further comprising separating at least part of said combined stream in said distillation/condensation subsystem into an original lean stream used to provide said first and second lean streams and an original enriched stream used to provide said rich stream.

15. The method of claim 14 further comprising splitting said original lean stream in said distillation/condensation subsystem to provide said first and second lean streams.

16. The method of claim 14 wherein said original enriched stream is in the form of a vapor, said original lean stream is in the form of a liquid, and said separating is carried out in a separator in said distillation/condensation subsystem.

17. The method of claim 16 wherein said original enriched stream is cooled by transferring heat to preheat and partially vaporize said at least part of said combined stream prior to separating in said separator.

18. The method of claim 14 further comprising splitting said combined stream in said distillation/condensation subsystem into a first combined stream portion that is separated into said original lean stream and said original enriched stream and a second combined stream portion, and mixing said second combined stream portion with said original enriched stream to provide said rich stream.

19. The method of claim 18 wherein said rich stream is condensed in said distillation/condensation subsystem by transferring heat to said low temperature fluid source and is pumped to increase its pressure.

20. The method of claim 18 wherein said original enriched stream is cooled by transferring heat to preheat said rich stream.

21. The method of claim 20 wherein said second lean stream is cooled prior to said combining with said spent stream by transferring heat to said first combined stream portion.

22. The method of claim 20 wherein said spent stream is cooled prior to said combining with said second lean stream by transferring heat to said first combined stream portion.

23. Apparatus for implementing a thermodynamic cycle comprising an first gas expander connected to receive a heated gaseous working stream including a low boiling point component and a higher boiling point component and to provide an expanded working stream, said first gas expander including a mechanical component that transforms the energy of said heated gaseous stream into useable form as it is expanded, a stream splitter connect to receive said expanded working stream and to split it into a first expanded stream and a second expanded stream, a second gas expander connected to receive said second expanded stream and to provide a spent stream, said second gas expander including a mechanical component that transforms the energy of said second expanded stream into useable form as it is expanded, a distillation/condensation subsystem that is connected to receive said spent stream and converts it to a first lean stream that is lean with respect to said low boiling point component and a rich stream that is enriched with respect to said low boiling point component, a regenerating subsystem that is connected to receive and combine said second expanded stream, said first lean stream, and said rich stream, and outputs said working stream, and a heater that is connected to receive said working stream and adds heat to said working stream to provide said heated gaseous working stream.

24. The apparatus of claim 23 further comprising a reheater for heating said first working stream prior to said expanding said first working stream at said second expander.

25. The apparatus of claim 23 wherein said distillation/condensation subsystem outputs said lean stream and said rich stream as fully condensed streams.

26. The apparatus of claim 25 wherein said regenerating subsystem includes a first junction at which said first lean stream and said second stream are combined to form an intermediate stream, a first heat exchanger that transfers heat from said intermediate stream to said rich stream to preheat said rich stream, and a second junction at which said intermediate stream and said preheated rich stream are combined.

27. The apparatus of claim 26 wherein said regenerating system further includes a second heat exchanger, and wherein said intermediate stream is condensed in said first and second heat exchangers, and wherein said regenerating subsystem further includes a pump that increases the pressure of said intermediate stream after it has been condensed, and wherein said pumped intermediate stream passes through said second heat exchanger to be preheated prior to travel to said second junction.

28. The apparatus of claim 27 wherein said first lean stream passes through said second heat exchanger to be preheated using heat from said cooling of said intermediate stream prior to travel to said first junction.

29. The apparatus of claim 23 wherein said distillation/condensation subsystem generates a second lean stream and includes a first junction for combining said second lean stream with said spent stream to provide a combined stream, and a condenser that condenses said combined stream by transferring heat to a low temperature fluid source.

30. The apparatus of claim 29 wherein said distillation/condensation subsystem further comprises a stream separator that separates at least part of said combined stream in said distillation/condensation subsystem into an original lean stream used to provide said first and second lean streams and an original enriched stream used to provide said rich stream.

31. The apparatus of claim 30 wherein said distillation/condensation subsystem further comprises a stream splitter that splits said original lean stream to provide said first and second lean streams.

32. The apparatus of claim 30 wherein said original enriched stream is in the form of a vapor, said original lean stream is in the form of a liquid.

33. The apparatus of claim 32 wherein said distillation/condensation subsystem includes heat exchangers in which said original enriched stream and lean streams are cooled by transferring heat to preheat and partially vaporize said at least part of said combined stream prior to separating in said separator.

34. The apparatus of claim 30 wherein said distillation/condensation subsystem further comprises a splitter that splits said combined stream into a first combined stream portion that is directed to said stream separator and a second combined stream portion, and further comprises a junction at which said second combined stream portion and said original enriched stream are combined to provide said rich stream.

35. The apparatus of claim 34 wherein said distillation/condensation subsystem further comprises a second condenser at which said rich stream is condensed by transferring heat to said low temperature fluid source and further includes a pump that pumps said condensed rich stream to increase its pressure.

36. The apparatus of claim 34 wherein said distillation/condensation subsystem includes a heat exchanger in which said original enriched stream is cooled by transferring heat to preheat said rich stream.

37. The apparatus of claim 36 wherein said distillation/condensation subsystem includes a heat exchanger to cool said second lean stream prior to combining with said spent stream at said first junction by transferring heat to said first combined stream portion.

38. The apparatus of claim 36 wherein said distillation/condensation subsystem includes a heat exchanger to cool said spent stream prior to said combining with said second lean stream at said first junction by transferring heat to said first combined stream portion.

* * * * *